United States Patent [19]

Fischer

[11] 4,428,255

[45] Jan. 31, 1984

[54] LOCK PIN ASSEMBLY

[75] Inventor: Robert L. Fischer, New Lenox, Ill.

[73] Assignee: Caterpillar Tractor Co., Peoria, Ill.

[21] Appl. No.: 277,750

[22] PCT Filed: Mar. 16, 1981

[86] PCT No.: PCT/US81/00328

§ 371 Date: Mar. 16, 1981

§ 102(e) Date: Mar. 16, 1981

[87] PCT Pub. No.: WO82/03194

PCT Pub. Date: Sep. 30, 1982

[51] Int. Cl.[3] ..... B23Q 17/00; E02F 3/14

[52] U.S. Cl. ..... 74/813 L; 414/694; 37/118 R; 403/408

[58] Field of Search ..... 74/813 L, 816, 813 R; 188/69; 414/687, 694, 735; 37/118 R; 172/789; 403/260, 408

[56] References Cited

U.S. PATENT DOCUMENTS

| | | | |
|---|---|---|---|
| 1,923,440 | 8/1933 | Hunt et al. | 74/813 L |
| 3,118,347 | 1/1964 | Thompson | 90/56 |
| 3,450,213 | 6/1969 | Creighton et al. | 172/785 |
| 3,540,312 | 11/1970 | Russ | 74/813 |
| 3,692,149 | 9/1972 | Evans | 188/69 |
| 3,972,378 | 8/1976 | Houriez et al. | 180/6.58 |
| 4,042,131 | 8/1977 | Buttke | 414/694 |
| 4,132,290 | 1/1979 | Dezelan et al. | 188/69 |

*Primary Examiner*—Kenneth J. Dorner
*Attorney, Agent, or Firm*—Claude F. White

[57] ABSTRACT

A lock pin assembly (42) is movable axially to engage an opening (96,98,100) in a pin receiving portion (94) of an indexable apparatus (10). The apparatus (10) includes a first member (34) which carries the pin receiving portion (94) and a second member (36) which carries the lock pin assembly (42). The first and second members (34,36) are movable, one with respect to the other, and the lock pin assembly (42) serves to lock the members (34,36) against movement. The lock pin assembly (42) is secured to a moving means (44) which moves the pin assembly (42) into and out of engagement with the pin receiving portion (94). The first and second members (34,36) are subjected to severe loading and vibrations which attempt to move the first member (34) with respect to the second member (36). The lock pin assembly (42) resists the loading and vibrations and isolates the moving means (44) from bending loads imposed upon the pin assembly (42).

7 Claims, 5 Drawing Figures

LOCK PIN ASSEMBLY

TECHNICAL FIELD

This invention relates generally to a locking assembly and more particularly to a lock pin assembly for locking an indexable apparatus to a supporting structure while protecting the cylinder and rod from damaging forces and preventing rotation of the apparatus with respect to the supporting structure.

BACKGROUND ART

Earthworking apparatus, such as rockbreakers, trenchers, and impact rippers, are used to fracture and rip rock and dig trenches in the earth. Such apparatus is generally mounted upon an earthmoving machine which provide mobility for the apparatus. The mounting generally provides for rotation of the apparatus to various angular positions relative to the machine.

After the earthworking apparatus has been rotated to a desired working position, it must be securely locked at that position.

During the work function, the entire earthworking apparatus is subjected to extremely high forces and rapid cycling of the loads. These forces can be transferred into the locking assembly and into the means which moves the locking assembly in and out of locking position. Such impact loading can cause distortion, bending, and damage to the locking assembly and the moving means.

One type of mechanism for locking a swingable support member to a frame member is disclosed in U.S. Pat. No. 3,692,149, issued to John H. Evans on Sept. 19, 1972. In this patent, a locking pin is selectively entered into one of several openings by a double acting hydraulic jack. The locking pin is rigidly secured to the rod of the hydraulic jack, as by welding. Therefore, when high side loads are applied to the locking pin by the swingable support member or the frame member, such loads are undesirably transferred into the rod of the hydraulic jack. These loads can cause distortion and bending of the rod and damage to the seals of the hydraulic jack. In severe case, the jack itself can be damaged.

The present invention is directed to overcoming one or more of the problems as set forth above.

DISCLOSURE OF THE INVENTION

In one aspect of the present invention, a locking assembly securely locks a movable member to a support member and prevents rotation of the movable member. The locking assembly is actuated from a locked and unlocked position by a moving means. The locking assembly is of a construction sufficient for isolating the moving means from bending loads applied on the pin assembly.

BEST MODE FOR CARRYING OUT THE INVENTION

Figure 1:
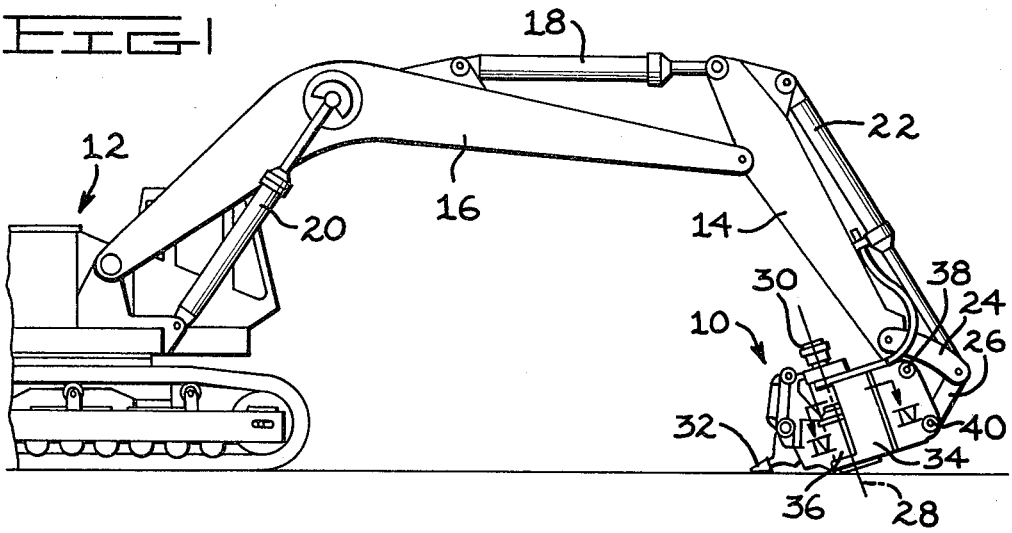
FIG. 1 is a diagrammatic side elevational view of an embodiment of the present invention illustrated in connection with a material fracturing apparatus mounted on a mobile earthmoving machine.

Referring to FIG. 1, a material fracturing apparatus 10, is mounted on an earthworking machine 12 by means of an arm 14 and a boom 16. The arm 14 and boom 16 are moved by fluid cylinders 18 and 20 respectively. In addition to manipulations of the arm 14 and boom 16, the apparatus 10 is further positionable by a fluid cylinder 22 which is connected to the arm 14 by a link 24 and to the apparatus 10 by a link 26.

The fracturing apparatus 10 is suitably mounted for limited indexable rotation about an axis 28. The apparatus 10 includes an energy source, such as fluid motor 30 and associated flywheels (not shown), for activating an earthworking tool or ripper tip 32.

The material fracturing apparatus 10 has a first member or structure 34 which supports a second member or case 36 for limited rotation, as previously noted. The links 24 and 26 are attached to the support structure 34 by pivot pin 38 and 40. The case 36, and related components of the fracturing apparatus 10, are rotatable relative to the support structure by any suitable power means (not shown), by manipulating the arm 14, boom 16, machine 12, or any combination of these components.

Figure 2:
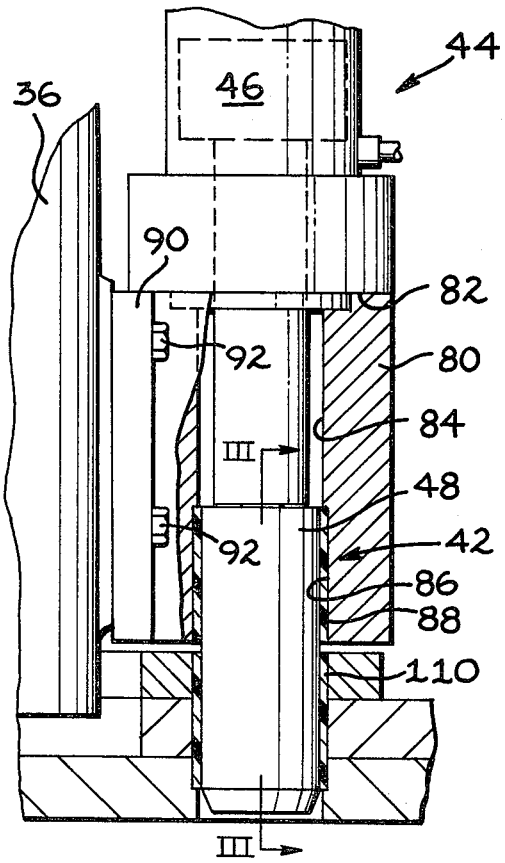
FIG. 2 is a diagrammatic side elevational view of the subject invention on an enlarged scale, with some parts in section.
Figure 3:
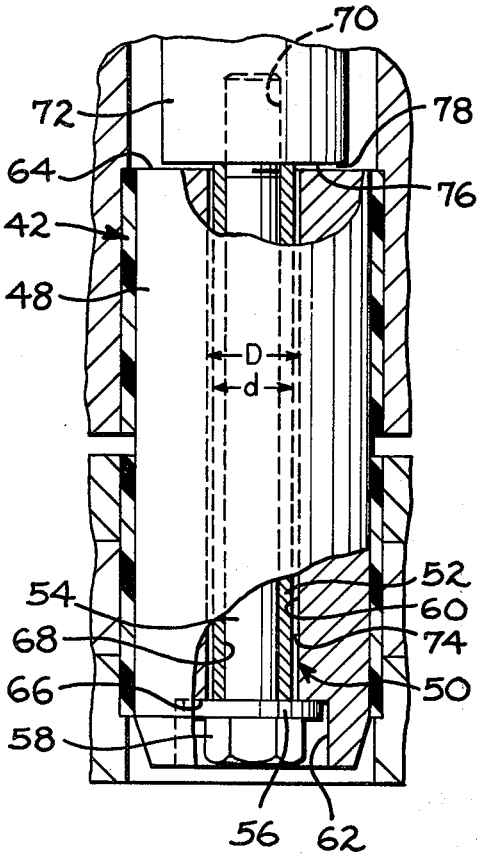
FIG. 3 is a diagrammatic sectional view of the lock pin assembly of the present invention taken generally along lines III—III of FIG. 2.

Referring to FIGS. 2 and 3, a locking assembly 42 is secured to a moving means 44 such as a fluid cylinder 46. The locking assembly 42 has a lock pin 48, and means 50 for securing the lock pin 48 to the fluid cylinder 46. In the embodiment illustrated, the securing means 50 has a spacer 52, a threaded fastener 54, and a washer 56. If desired, the washer 56 can be formed integral with the head 58 of the threaded fastener 54.

As illustrated in FIG. 3, the lock pin 48 has a through bore 60 and a counterbore 62. The through bore 60 extends from an end 64 of the pin 48 to the bottom 66 of the counterbore 62. The spacer 52 has a bore 68 for receiving the threaded fastener 54, which threads into a threaded bore 70 in a piston rod 72, which is part of the fluid cylinder 46. As is evident from FIG. 3, the diameter "d" of the spacer 52 is less than the diameter "D" of the through bore 60. The spacer 52 and through bore 60 therefore define a controlled annulus 74.

The spacer 52 is held securely in response to being tightly clamped between the washer 56 and the head 58 of the threaded fastener 54 on one end and by a surface 76 of the piston rod 72 on the opposite end. The overall length of the spacer 52 is greater than the length of the through bore 60, which provides a space 78 of predetermined magnitude between the end 64 of the pin 48 and the surface 76 of piston rod 72. The annulus 74 and the space 78 provide for controlled radial and axial motion of the lock pin 48 relative to the moving means 44, which includes the fluid cylinder 46 and the piston rod 72.

Referring to FIG. 2, the moving means 44 is supported by and secured to a mounting portion 82 of the housing 80. The housing 80 also has an internal cavity 84 and a counterbore 86. The cavity 84 encloses the previously described locking pin 48, and the counterbore 86 holds a replaceable bearing 88 that is press fitted into the counterbore 86. The housing 80 is secured to the case 36 by a mounting plates 90 and a plurality of fasteners 92. Therefore, the housing 80, moving means 44, and locking assembly 42 rotate with the case 36.

Figure 4:
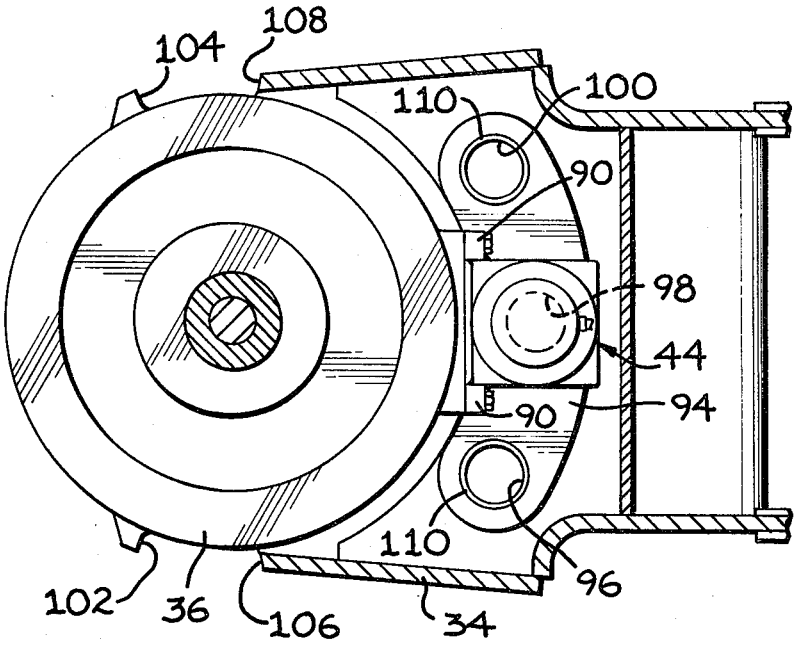
FIG. 4 is a diagrammatic sectional view taken generally along lines IV—IV of FIG. 1.
Figure 5:
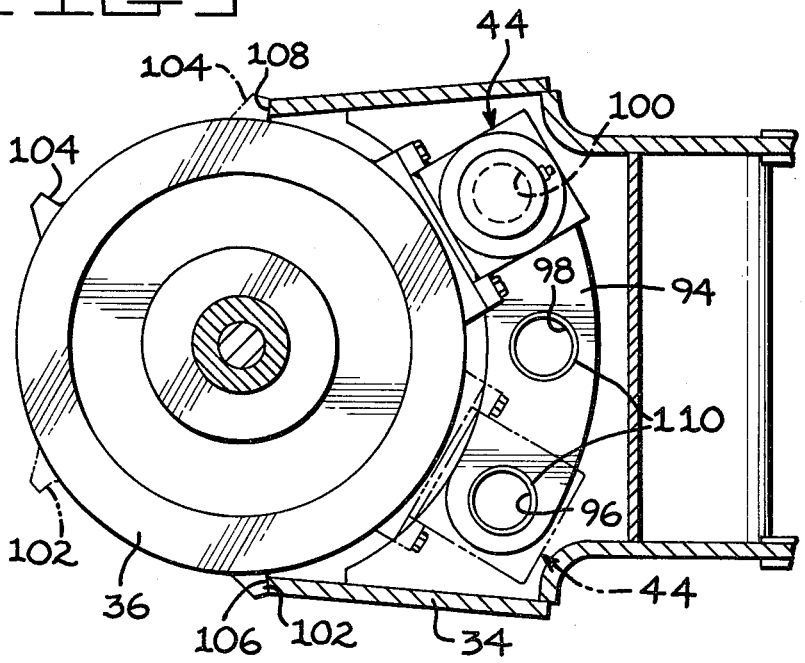
FIG. 5 is a diagrammatic sectional view similar to FIG. 4, with portions of the apparatus rotated to a different position.

Referring to FIGS. 4 and 5, the support structure 34 has a pin receiving portion 94 which receives the lock pin 48 for resisting rotation of the case 36 when the case 36 and support structure 34 are locked together. The pin receiving portion 94 has a plurality of spaced openings 96, 98, and 100, one of which receives the lock pin 48 when it is activated by the moving means 44. In FIG. 4, the case 34 is at a straight forward position with the lock pin 48 in the center hole 98. In FIG. 5, the case 34 has been rotated to the left and the lock pin 48 is in hole 100. The case 36 includes first and second stop members 102 and 104 and the support structure 34 includes first and second stop portions 106 and 108. As the case 36 is rotated to the left, as shown in FIG. 5, the first stops 102 on case 36 engage the first stop 106 on the support structure 34. In a similar manner, as the case is rotated to the right, second stop 104 on case 36 engages second stop 108 on the support structure 34.

As the case 36 is rotated to the left and the first stops 102 and 106 engage, the locking assembly 42 is generally axially aligned with the opening 100 and upon activation of the moving means 44, the lock pin 48 engages the opening 100 and locks the case 36 and the support structure 34 together. Likewise, the locking assembly 42 becomes generally axially aligned with the opening 96 as the case 36 is rotated to the right and the second stops 104 and 108 engage.

Referring to FIGS. 2, 4, and 5, each of the openings 96, 98, and 100 contain a replaceable bearing 110. Preferably, the bearing 110 and the bearing 88, in the cavity 86, are non-metallic and provide resiliency between the pin 48 and the bearings 88, 110.

INDUSTRIAL APPLICABILITY

The subject lock pin assembly 42 is particularly useful for locking a rotatable material fracturing apparatus 10 to a support structure 34 and preventing the apparatus 10 from rotating in response to impact loading.

The material fracturing apparatus 10 is particularly suited for digging trenches or fracturing rock and is movable relative to the earthworking machine 12. For example, the apparatus 10 can be rotated from side to side for digging a wide trench or cleaning the corners of a trench.

To initiate rotation of the apparatus 10, the fluid cylinder 46 is activated to retract the rod 72 and the associated lock pin 48. The apparatus 10 is then rotated to the desired angular position relative to the machine 12 and the fluid cylinder 46 is activated to extend the rod 72 and the attached lock pin 48. The lock pin 48 enters one of the openings 96, 98, or 100 and is held in this locked position by pressure in the fluid cylinder 46.

During operation of the apparatus 10, large axial forces are generated by the ripper tip 32 and transferred into the case 36. These forces urge the case 36 relative to the support structure 34, and exert a shear force on the pin 48. This shear force can be of sufficient magnitude to bend the pin 48, the attached piston rod 72 and damage the seals of the fluid cylinder 46. However, in the subject construction, the annulus 74 and the space 78 provide clearance for the lock pin 48 to float or move radially and axially within controlled limits. Therefore, the pin 48 and bearings 88, 110 move relative to the securing means 50 and restrict loads from being subjected onto the fastener 54 and rod 72.

The limited resiliency of the bearings 88 and 110 also maintains the locking assembly 42 against axial loading which in turn prevents fretting and pitting of the pin 48 and the internal surfaces of the openings 96, 98, and 100, thereby reducing the waste of material.

Other aspects, objects and advantages of this invention can be obtained from a study of the drawings, the disclosure, and the appended claims.

What is claimed is:

1. In an indexable apparatus (10) having a first member (34) having a pin receiving portion (94) and a second member (36) having a locking assembly (42) including a lock pin (48), said members (34,36) being supported for relative rotation, and means (44) for moving said locking assembly (42) into engagement with said receiving portion (94), the improvement comprising:

means (50) for securing said lock pin (48) to said moving means (44) and providing controlled radial and axial motion of said lock pin (48) relative to said moving means (44), said lock pin (48) having a through bore (60) having a diameter D, said means (50) including a spacer (52) and a threaded fastener (54) extending through said bore (60) with said fastener (54) engaging said moving means (44), said spacer (52) having a diameter d which is less than the diameter D of said bore (60), said spacer (52) and said bore (60) defining a controlled annulus (74).

2. The improvement, as set forth in claim 1, wherein the length of said spacer (52) is greater than the length of said through bore (60) and said spacer (52) is held against movement between said threaded fastener (54) and said moving means (44) with said pin (48) and moving means (44) being spaced one from the other by said spacer (52).

3. The improvement, as set forth in claim 1, wherein said first and second members (34,36) each include first and second stops (102,106,104,108), said first stops (102,106) being engageable during rotation of said second member (36) in one direction and said second stops (104,108) being engageable during rotation of said second member (36) in the opposed direction.

4. The improvement, as set forth in claim 3, wherein said pin receiving portion (94) includes a plurality of spaced openings (96,98,100) and said locking assembly (42) is generally axially aligned with one of said openings (96,98,100) when said first stops (102,106) are engaged and generally axially aligned with a different one of said openings (96,98,100) when said second stops (104,108) are engaged.

5. The improvement, as set forth in claim 4, including a replaceable bearing (110) within each of said openigns (96,98,100).

6. The improvement, as set forth in claim 5, wherein said second member (36) includes a housing (80) having a mounting portin (82) and an internal cavity (84), said moving means (44) being secured to said mounting portion (82) and said locking pin (48) being enclosed within said cavity (84), and including a counterbore (86) within said housing (80) and a replaceable bearing (88) secured within said counterbore (86).

7. The improvement, as set forth in claim 5, wherein said replaceable bearings (86,110) are non-metallic.

* * * * *